US011092012B2

(12) United States Patent
Stanka et al.

(10) Patent No.: US 11,092,012 B2
(45) Date of Patent: Aug. 17, 2021

(54) TURBOMACHINE COMPONENT ARRANGEMENT

(71) Applicant: MTU Aero Engines AG, Munich (DE)

(72) Inventors: Rudolf Stanka, Rattenkirchen (DE); Martin Fischer, Olching (DE); Hans Zimmermann, Landshut (DE); Martin Becker, Dachau (DE); Luitpold Frey, Fuerstenfeldbruck (DE)

(73) Assignee: MTU Aero Engines AG, Munich (DE)

( * ) Notice: Subject to any disclaimer, the term of this patent is extended or adjusted under 35 U.S.C. 154(b) by 758 days.

(21) Appl. No.: 15/935,008

(22) Filed: Mar. 25, 2018

(65) Prior Publication Data

US 2018/0274367 A1 Sep. 27, 2018

(30) Foreign Application Priority Data

Mar. 27, 2017 (DE) ..... 10 2017 205 122.1

(51) Int. Cl.
*F01D 5/06* (2006.01)
*F01D 25/24* (2006.01)
*F01D 5/02* (2006.01)

(52) U.S. Cl.
CPC ..... *F01D 5/066* (2013.01); *F01D 5/026* (2013.01); *F01D 25/246* (2013.01); *F05B 2260/301* (2013.01); *F05D 2230/644* (2013.01); *F05D 2240/55* (2013.01); *F05D 2250/31* (2013.01)

(58) Field of Classification Search
CPC . F01D 5/026; F01D 5/06; F01D 5/066; F01D 5/08; F01D 25/243; F01D 25/246
See application file for complete search history.

(56) References Cited

U.S. PATENT DOCUMENTS

| | | | | |
|---|---|---|---|---|
| 5,593,277 | A | 1/1997 | Proctor et al. | |
| 5,816,776 | A * | 10/1998 | Chambon | F01D 5/066 415/174.5 |
| 7,210,909 | B2 * | 5/2007 | Escure | F01D 5/066 29/402.03 |
| 7,364,402 | B2 * | 4/2008 | Brault | F01D 5/027 415/174.5 |
| 9,845,704 | B2 * | 12/2017 | Szarvasy | F02C 7/18 |
| 2005/0025625 | A1 | 2/2005 | Escure et al. | |
| 2016/0177765 | A1 | 6/2016 | Lemoine et al. | |

FOREIGN PATENT DOCUMENTS

| | | | |
|---|---|---|---|
| DE | 60316873 | T2 | 4/2008 |
| EP | 1091089 | A2 | 4/2001 |
| EP | 1717415 | B1 | 6/2008 |
| EP | 2886807 | A1 | 6/2015 |
| EP | 315650 | A1 | 4/2017 |
| EP | 3156590 | A1 | 4/2017 |
| GB | 2244523 | A | 12/1991 |

* cited by examiner

*Primary Examiner* — Daniel J Wiley
(74) *Attorney, Agent, or Firm* — Barlow Joseph and Holmes Ltd; David Josephs

(57) ABSTRACT

A rotor, for a turbomachine, in particular a gas turbine, having a first flange and a second flange with recesses that are distributed in a direction of distribution, in particular in the peripheral direction, wherein the second flange is fastened to the first flange, in particular detachably, by at least one fastener, which engage in the first of these recesses of the first and second flanges, wherein second ones of these recesses of the first flange, which are free of a fastener, are covered by the second flange.

13 Claims, 1 Drawing Sheet

TURBOMACHINE COMPONENT ARRANGEMENT

BACKGROUND OF THE INVENTION

Figure 1:
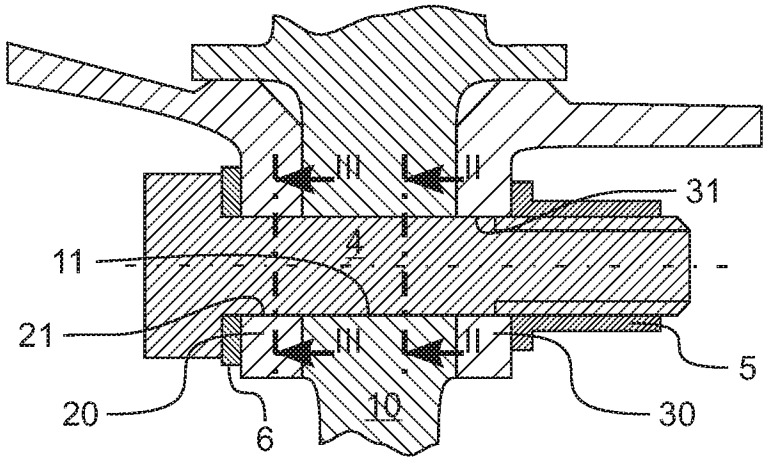

The present invention relates to a component arrangement, in particular a rotor (part), for a turbomachine, in particular a gas turbine, as well as to a turbomachine, in particular a gas turbine having the component arrangement, and a method for mounting the component arrangement.

Known from US 2005/0025625 A1 is a rotor of an aircraft engine gas turbine, for which three flanges are fastened detachably to one another by screws, which, for this purpose, engage in through-holes of the flange, and are screwed into nuts.

SUMMARY OF THE INVENTION

An object of an embodiment of the present invention is to improve a turbomachine.

This object is achieved by a component arrangement of the present invention. The present invention is also directed to a turbomachine with at least one component arrangement described herein, and to a method for mounting a component arrangement also described herein. Advantageous embodiments of the invention are discussed in detail below.

In accordance with an embodiment of the present invention, (at least) one component arrangement, in particular a rotor or a rotor part, for a turbomachine, in particular a gas turbine, in particular an aircraft engine gas turbine, in particular (at least) one component arrangement, in particular a rotor or rotor part, of a turbomachine, in particular a gas turbine, in particular an aircraft engine gas turbine, has (respectively) a first flange, in particular a ring- or ring-segment-like flange or annular flange, and a second flange, in particular a ring- or ring-segment-like flange or annular flange, with recesses that are distributed in a direction of distribution, in particular in a peripheral direction, around a (rotational or main) machine axis of the turbomachine, in particular through-holes, in particular through-bores, which, in one embodiment, have closed peripheral surface areas or do not open into peripheral surface areas of this flange or do not extend all the way to the peripheral surface areas of this flange.

In accordance with an embodiment of the present invention, the second flange is to be fastened or is fastened to the first flange, in particular detachably, by at least one fastener, such as screws or bolts, which (for this purpose) engage in some of these recesses of the first and second flanges in a further development, engage (for this purpose) through these recesses of the first and/or second flange, and/or are to be screwed or are screwed with nuts. In the present case, these recesses of the first and second flange are referred to, for more compact presentation, as first recesses (distributed in the direction of distribution) of the first or second flange.

In accordance with one embodiment of the present invention, the first flange has additional recesses (which are distributed in the direction of distribution) that are free of fasteners and, in particular, are empty.

In this way, in one embodiment, it is possible advantageously for stresses, in particular thermally induced stresses, to be reduced in the first flange, and thus to increase the service life thereof.

In accordance with one embodiment of the present invention, some and preferably all of these additional recesses (distributed in the direction of distribution) of the first flange, which are free of any fasteners and, in particular, are empty, are to be covered or are covered by the second flange and, in particular, are covered in an air-tight manner. These recesses (covered by the second flange and free of any fasteners, in particular empty) of the first flange are referred to in the present case, for more compact presentation, as second recesses (distributed in the direction of distribution) of the first flange. Accordingly, in one embodiment, the total number of recesses, distributed in the direction of distribution, of the first flange is composed of the first recesses thereof, into which the fasteners engage and, in particular, engage continuously through the recesses, and its second recesses, which are free of any fasteners and, in particular, are empty.

In this way, in one embodiment, it is possible advantageously to reduce and preferably to prevent any leakage of fluid through the second recesses of the first flange.

In one embodiment, the second flange, too, has additional recesses (distributed in the direction of distribution) that are free of any fasteners and, in particular, are empty.

In this way, in one embodiment, it is possible advantageously to reduce stresses, in particular thermally induced stresses, in the second flange, and thus to increase the service life thereof.

In one embodiment, some and preferably all of these additional recesses (distributed in the direction of distribution) of the second flange, which are free of any fasteners and, in particular, are empty, are to be covered or are covered conversely by the first flange, in particular in an airtight manner. These recesses (covered by the first flange and free of any fasteners, in particular empty) of the second flange are analogously referred to in this case, for more compact presentation, as second recesses (distributed in the direction of distribution) of the second flange. Accordingly, in one embodiment, the total number of recesses, distributed in the direction of distribution, of the second flange is composed of the first recesses thereof, in which the fasteners engage and, in particular, engage through the recesses, and of its second recesses that are free of any fasteners and, in particular, are empty.

In this way, in one embodiment, it is possible advantageously to reduce and preferably to prevent any leakage of fluid through the second recesses of the second flange.

In one embodiment, the component arrangement has a third flange, in particular a ring- or ring-segment-like flange or annular flange, which has recesses distributed in the direction of distribution, in particular through-holes, in particular through-bores, which, in one embodiment, have closed peripheral surface areas or do not open into peripheral surface areas of this flange or do not extend all the way to the peripheral surface areas of this flange.

In one embodiment, the third flange is to be fastened or is fastened to the first flange, in particular on the side thereof that lies opposite to the second flange and/or detachably, by at least one fastener, in particular screws or bolts, which (for this purpose) engage in some of these recesses of the third flange, and (for this purpose) engage through them in an enhancement and/or are to be screwed or are screwed with nuts. These recesses of the third flange are referred to analogously in the present case, for more compact presentation, as first recesses (distributed in the direction of distribution) of the third flange.

In one embodiment, the first flange is part of a rotor disk and serves the second and/or third flange (respectively) for connection of the rotor disk to an adjacent rotor disk. These may involve here, in particular, bladed rotor disks of a turbine or a compressor or else rotor disks that are formed for the uptake of turbine or compressor blades.

In an enhancement, it is possible for some or all of the recesses in the first, second, and/or third flange to be circular through-holes and/or to have the same shape and size. Additionally or alternatively, all recesses of the first, second, and/or third flange can have the same distance from the axis of rotation of the rotor.

In one embodiment, the fasteners that engage in and, in particular, engage through the first recesses of the third flange can be the (same) fasteners that also connect the first and second flanges to each other or engage (in) or engage through the first recesses thereof. Accordingly, in one embodiment, the (same) fasteners engage in the first recesses of the first, second, and third flange and, in an enhancement, these fasteners engage through the first recesses of the first, second, and/or third flange.

In this way, in one embodiment, it is possible to achieve an advantageous and particularly compact mounting of the flange.

In one embodiment, some and preferably all of the recesses (distributed in the direction of distribution) of the first flange, which are free of any fasteners and, in particular, are empty, are to be covered or are covered by the third flange, in particular in an airtight manner, in particular the second recesses (also covered by the second flange) of the first flange, which accordingly, in one embodiment, are to be covered or are covered on both sides by the second and third flanges, particularly in an airtight manner.

In this way, it is possible to achieve an advantageous, particularly compact mounting of the flange and/or to reduce (further) and preferably (reliably) to prevent any leakage of fluid through recesses, in particular the second recesses, of the first flange.

In one embodiment, the third flange has additional recesses (distributed in the direction of distribution), which are free of any fasteners, and, in particular, are empty.

In this way, in one embodiment, it is possible advantageously to reduce stresses, in particular thermally induced stresses, in the third flange and thus to increase the service life thereof.

In one embodiment, some and preferably all of these additional recesses (distributed in the direction of distribution) of the third flange, which are free of any fasteners and, in particular, are empty, are to be covered or are covered by the first flange, in particular in an airtight manner. These recesses (covered by the first flange) of the third flange are referred to analogously in the present case, for more compact presentation, as second recesses (distributed in the direction of distribution) of the third flange. Accordingly, in one embodiment, the total number of recesses, distributed in the direction of distribution, of the third flange is composed of the first recesses thereof, in which the fasteners engage, and in particular through which they engage, and its second recesses, which are free of any fasteners and, in particular, are empty.

In this way, in one embodiment, it is possible advantageously to reduce and preferably to prevent any leakage of fluid through the second recesses of the third flange.

In one embodiment, two recesses of the second and third flanges are aligned with each other.

In this way, it is possible, in one embodiment, to achieve a component arrangement that is advantageous in terms of engineered balance and/or is compact, and/or to improve the mounting thereof.

In one embodiment, the component arrangement may be composed of the first and second flanges or of the first, second, and third flanges with the fasteners, or have additional elements, particularly flanges.

In one embodiment, in the direction of distribution, the first flange has alternating arrangements, which are composed of one, two, or a plurality of, and, in particular, at most four (of the) second recesses of this flange, which are adjacent in the direction of distribution, and arrangements that as composed of one, two, or a plurality of, and, in particular, at most four (of the) first recesses of this flange, which are adjacent in the direction of distribution; in an enhancement, the total number of recesses, which are distributed in the first direction of distribution, of the first flange is composed of these alternating arrangements, so that, in one advantageous embodiment, there results, in the direction of distribution, a pattern (two first recesses, in which the fasteners engage)-(one second recess covered by the second flange, and, if appropriate, the third flange)-(two first recesses, in which the fasteners engage)-(one second recess, covered by the second flange, and, if appropriate, the third flange-(two first recesses, in which the fasteners engage) . . . .

In an enhancement, preferably all first recesses of these arrangements of the first flange that are adjacent in the direction of distribution are to be arranged or are arranged symmetrically in each case or within their arrangement, and/or are spaced equidistant apart from one another and/or from second recesses of these arrangements that are adjacent to this arrangement or to these first recesses (directly in the direction of distribution). Additionally or alternatively, preferably all second recesses of these arrangements of the first flange, which are adjacent in the direction of distribution, are to be arranged or are arranged symmetrically in each case or within their arrangement and/or are spaced equidistant apart from one another and/or from this arrangement or from the first recesses of these arrangements that are adjacent to these second recesses (directly in the direction of distribution).

Additionally or alternatively, in one embodiment, the second and/or third flange have or has (respectively) alternating arrangements in the direction of distribution, which are composed of one, two, or a plurality of and, in particular, at most four (of the) second recesses of this flange, which are adjacent in the direction of distribution, and arrangements that are composed of one, two, or a plurality of and, in particular, at most four (of the) first recesses of this flange, which are adjacent in the direction of distribution; in an enhancement, the total number of recesses of the second and/or third flange(s), which are distributed in the direction of distribution, is composed (respectively) of these alternating arrangements, so that, in an advantageous embodiment, in the direction of distribution, there results a pattern (two first recesses, in which the fasteners engage)-(two second recesses, covered by the first flange)-(two first recesses, in which the fasteners engage)-(two second recesses, covered by the first flange)-(two first recesses, in which the fasteners engage).

In an enhancement, preferably all first recesses of theses arrangement of the second flange, which are adjacent in the direction of distribution, are to be arranged or are arranged symmetrically in each case or within their arrangement, and/or are spaced equidistant apart from one another and/or from this arrangement or from second recesses of these arrangements that are adjacent or to these first recesses (directly in the direction of distribution). Additionally or alternatively, preferably all second recesses of these arrangements of the second flange, which are adjacent in the direction of distribution, are to be arranged or are arranged symmetrically in each case or within their arrangement, and/or are spaced equidistant apart from one another and/or from this arrangement or these first recesses of these arrangements that are adjacent to these second recesses (directly in the direction of distribution).

Additionally or alternatively, preferably all first recesses of these arrangements of the third flange, which are adjacent in the direction of distribution, are to be arranged or are arranged symmetrically in each case or within their arrangement, and/or are spaced equidistant apart from one another and/or from this arrangement or from the first recesses of these arrangements that are adjacent to these second recesses (directly in the direction of distribution). Additionally or alternatively, preferably all second recesses of these arrangements of the third flange, which are adjacent in the direction of distribution, are to be arranged or are arranged symmetrically in each case or within their arrangement, and/or are spaced equidistant apart from one another and/or from this arrangement, or from these first recesses that are adjacent to these second recesses (directly in the direction of distribution).

In this way, in one embodiment, it is possible to achieve an advantageous, particularly compact mounting of the flange, to reduce stresses, in particular thermally induced stresses, in the flanges, and thus to increase the service life thereof and/or to reduce (further) and preferably (reliably) prevent any leakage of fluid through the second recesses of the flange, and/or to achieve a component arrangement that is advantageous in terms of engineered balance, and/or is compact. Accordingly, in particular, in a preferred embodiment, there results a non-uniform, but symmetric distribution of the recesses of the second and/or third flange.

In one embodiment, between one pair or a plurality of and preferably all pairs (adjacent in the direction of distribution) of these arrangements, which are adjacent to the direction of distribution, of the first flange, which are each composed of one or more and, in particular, at most four (of the) first recesses, which are adjacent in the direction of distribution, of the first flange, in which the fasteners (of the respective pair) engage, and the (corresponding or opposite-lying or thus connected by these fasteners) pairs of these arrangements, each of which are adjacent in the direction of distribution, of the second and/or third flange, which is composed of one or a plurality of, and, in particular, at most four (of the) first recesses, which are adjacent in the direction of distribution, of this flange, in which the fasteners (of the respective pair of arrangements of the first flange) engage, a number that differs from zero and, in particular, is an odd number, in particular a number, differing by 1, of the second recesses are arranged in such a way that, for example, in an advantageous embodiment, in the direction of distribution, in each case in a gap between arrangements of the first recesses of the first flange with the fasteners, a second recess of the first flange, which is free of any fasteners and, in particular, is empty, and, between the arrangements of first recesses of the second or third flange with these fasteners, (in each case) two second recesses of the second or third flange, which are free of any fasteners and, in particular, are empty, are arranged or are to be arranged, hence a number different by one.

In other words, in one embodiment, between one pair or a plurality of, and preferably all pairs (adjacent in the direction of distribution) of the arrangements, which are adjacent to the direction of distribution, of the first flange, each of which is composed of one or more, and, in particular, at most four (of the) first recesses, which are adjacent in the direction of distribution, of the first flange, in which the fasteners (of the respective pair) engage, a first number of the second recesses are arranged in each case, and, between the (corresponding or opposite-lying or thus connected by these fasteners) pairs of the arrangements, which are adjacent in the direction of distribution, of the second and/or third flange, each of which is composed of one or a plurality of, and, in particular, at most four (of the) first recesses, which are adjacent in the direction of distribution, of this flange, in which these fasteners (of the respective pair of arrangements of the first flange) engage, a second number of the second recesses are arranged in each case, a number that differs from zero, particularly an odd number, in particular a number that is different or varies, particularly by 1, from the first number, of second recesses.

In this way, in one embodiment, an advantageous and, in particular, compact mounting of the flange is achieved; stresses, in particular thermally induced stresses, are reduced in the flanges, and thus the service life thereof is increased and/or any leakage of fluid through the second recesses of the flange is (further) reduced and preferably (reliably) prevented. In particular, in a preferred embodiment, there accordingly results a non-uniform, but symmetric distribution of the recesses of the second and/or third flange.

In one embodiment, a total number of first recesses of the first flange is unequal to and, in particular, greater than a total number of second recesses of the first flange, in particular by at least 10%, preferably by at least 30%, and/or at most 100%, preferably greater by at most 75%, preferably greater by 50%, at least essentially.

In one embodiment, the total number of first recesses is determined by a predetermined strength of the fastening of the flanges to one another and can correspond, in particular, to a minimum number of fasteners that are required for ensuring a predetermined strength of the fastening of the flanges to one another. Surprisingly, it has been found that, through a total number of the second recesses of the first flange with the lower and/or upper limits mentioned here, it is possible especially advantageously to reduce stresses, in particular thermally induced stresses, in the flange.

In one embodiment, a total number of first recesses of the second flange and/or of the third flange is (in each case) equal to a total number of second recesses of this flange. Additionally or alternatively, in one embodiment, the total number of first recesses of the second flange and/or of the third flange is (in each case) equal to the total number of first recesses of the first flange.

Surprisingly, it has been found that, through such a total number of second recesses (in each case, particularly in combination), it is possible especially advantageously to reduce stresses, in particular thermally induced stresses, in the flange.

In one embodiment, the first recesses of the first flange have an inner diameter that differs by at most 10%, in particular at most 5%, in particular at most 1%, from one another and/or differ from inner diameters of the second recesses of the first flange and/or from inner diameters of the first and/or second recesses of the second and/or third flange. Additionally or alternatively, in one embodiment, the second recesses of the first flange have inner diameters that differ by at most 10%, in particular at most 5%, in particular at most 1%, from one another and/or from inner diameters of the first and/or second recesses of the second and/or third flange. Additionally or alternatively, in one embodiment, the first recesses of the second and/or third flange have inner diameters that differ by at most 10%, in particular at most 5%, in particular at most 1%, from each other and/or from inner diameters of the second recesses of the second and/or third flange.

In this way, in one embodiment, it is possible to achieve an advantageous, particularly compact mounting of the flange, and/or (especially) advantageously to reduce stresses, in particular thermally induced stresses, in the flanges and thus to increase the service life thereof.

In one embodiment, the fasteners cover the first recesses of the first, second, and/or third flange in an airtight manner. In this way, in one embodiment, it is possible to reduce and preferably prevent any leakage of fluid through the first recesses.

In one embodiment, the fasteners can have screws, in particular screws that are screwed with nuts. In an enhancement, they have sealing elements, in particular disk-like sealing elements, for sealing, in particular airtight sealing, of the covered first recesses.

In this way, in one embodiment, it is possible advantageously for the flanges to become or to be fastened to one another.

BRIEF DESCRIPTION OF THE DRAWING FIGURES

Figure 2:
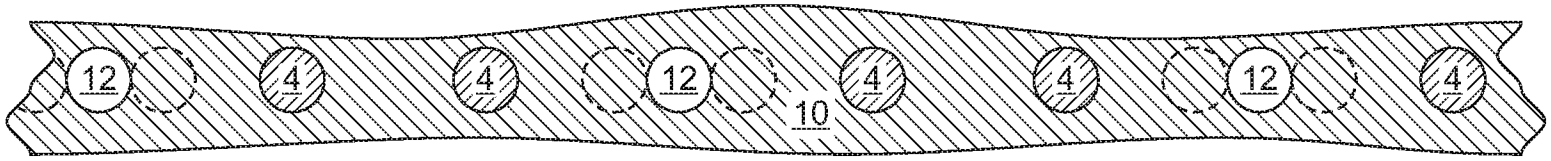
Figure 3:
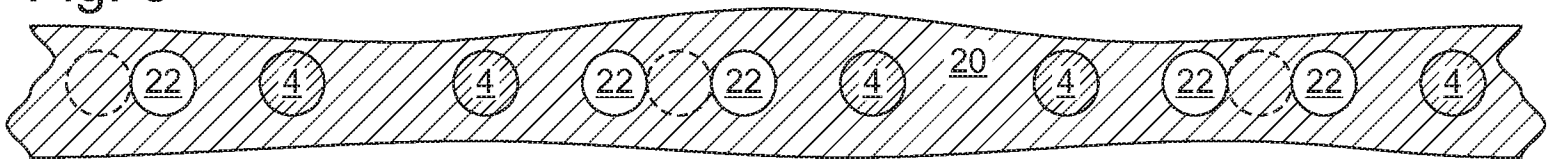

Further advantageous enhancements of the present invention ensue from the dependent claims and the following description of preferred embodiments. Shown for this purpose, in part schematically, are:

FIG. 1, a meridional section through a part of a component arrangement of a turbomachine in accordance with an embodiment of the present invention;

FIG. 2, a section through a first flange of the component arrangement along the line II-II in FIG. 1; and FIG. 3, a section through a second flange of the component arrangement along the line III-III in FIG. 1.

DESCRIPTION OF THE INVENTION

FIG. 1 shows a meridional section through a part of a component arrangement of a turbomachine in accordance with an embodiment of the present invention, which includes a machine axis of the turbomachine (horizontal in FIG. 1).

The component arrangement has a (middle) first flange 10 and an (outer) second flange 20 with through-holes 11, 12, 21, 22, which are distributed in the peripheral direction (horizontal in FIGS. 2, 3) around the machine axis, wherein the second flange 20 is fastened or is to be fastened to the first flange 10 detachably by screws 4, which, for this purpose, engage through first through-bores 11 of the first flange 10 and through first through-bores 21 of the second flange 20 of these through-bores of the first and second flange, which are distributed in the peripheral direction, and are screwed with nuts 5, wherein all (other) second through-bores 12 of the first flange 10, which are free of any fasteners, of these through-bores of the first flange 10, which are distributed in the peripheral direction, are covered by the second flange 20.

For this purpose, for clarification, the outlines of the second through-bores 12 of the first flange 10 are indicated as dashed lines in the section of the second flange 20 of FIG. 3.

Conversely, all (other) second through-bores 22 of the second flange 20, which are free of any fasteners, of these through-bores of the second flange 20, which are distributed in the peripheral direction, are covered by the first flange 10.

For clarification, the outlines of the second through-bores 22 of the second flange 20 are correspondingly indicated as dashed lines conversely in the section of the first flange 10 of FIG. 2.

The hole pattern of the third flange 30 is identical to that of the second flange 20, so that reference is made in this regard to the description thereof.

Correspondingly, the third flange 30 has through-bores that are distributed in the peripheral direction, and is to be fastened or is fastened to the first flange 10 detachably by the screws 4, which, for this purpose, engage through first through-bores 31 of these through-bores of the third flange 30, which are distributed in the peripheral direction, as well as through first through-bores 11 of the first flange 10 and through first through-bores 21 of the second flange 20, wherein all (other) second through-bores of the third flange 30 (not seen in the figure), which are free of any fasteners, of these through-bores, which are distributed in the peripheral direction, are covered by the first flange 10.

As can be seen in FIG. 2, the first flange 10 has arrangements that alternate in the peripheral direction, each of which is composed of one of the two recesses 12 of the first flange 10, and arrangements that are each composed of two of the first recesses 11 of this flange 10 in the peripheral direction, through which screws 4 engage: (11-11)-12-(11-11)-12-(11 . . . .

In this case, the first recesses 11 of this arrangement (11-11) that are adjacent in the direction of distribution are spaced apart equidistant from one another in each case or within their arrangement (11-11) as well as from second recesses 12, which are directly adjacent to this arrangement (11-11) or to these first recesses 11 in the direction of distribution, and, conversely, second recesses 12 of these arrangements (11-11), which are adjacent in the direction of distribution, are spaced apart equidistant in each case from first recesses 11, which are directly adjacent to this arrangement or to the second recess 12 in the direction of distribution.

As can be seen in FIG. 3, the second flange 20 has arrangements that alternate in the peripheral direction, each of which is composed of two of the second recesses 22 of the second flange 20 in the peripheral direction, and arrangements that are each composed of two of the first recesses 21 of this flange 20 in the peripheral direction, through which screws 4 engage: (21-21)-(22-22)-(21-21) . . . . The same applies analogously to the identical hole pattern of the third flange 30.

In this case, the first recesses 21 of this arrangement (21-21) that are adjacent in the direction of distribution are spaced apart equidistant from one another in each case or within their arrangement (21-21) and, additionally, second recesses 22 of these arrangements (22-22), which are adjacent in the direction of distribution, are spaced apart equidistant in this case or within their arrangement (22-22) from one another as well as from first recesses 21, which are directly adjacent to this arrangement (22-22) or to second recesses 22 in the direction of distribution.

Viewing FIGS. 2, 3 together shows that, between each pair of arrangements (11-11) of the first flange 10 that are adjacent in the direction of distribution, each of which is composed of two first recesses 11 of the first flange 10 in the direction of distribution, in which screws 4 engage, and a corresponding pair of adjacent arrangements (21-21) (or (31-31) of the second (and third) flange 20 (or 30) that are adjacent in the direction of distribution, each of which is composed of two first recesses 21 (or 31) of this flange that are adjacent in the direction of distribution, and in which screws 4 engage, a number of second recesses 12 or 22 that differs by one are arranged, namely in each case a (first number equal to one of the) second recess(es) 12 and in each case (a second number equal to) two (of the) second recess (es) 22.

As can be seen from the pattern (11-11)-12-(11-11)-12-(11 . . . of the first flange 10, the total number of first recesses 11 is 50% greater than the total number of second recesses 12.

As can be seen from the pattern (21-21)-(22-22)-(21-21)-(22 . . . of the second flange 20, the total number of first recesses 21 is equal to the total number of second recesses 22 and to the total number of first recesses 11 of the first flange 10. The same applies analogously for the identical hole pattern of the third flange 30.

The fasteners seal the first recesses in an airtight manner and, for this purpose, have sealing disks 6.

As is shown in FIGS. 2 and 3 by way of example, it is possible to provide in each of the flanges 10, 20, 30 or else only in one or two of the flanges 10, 20, 30 some or all of the recesses in the form of circular through-holes. In this case, all recesses of all flanges 10, 20, 30 can also have the same shape and size.

In other embodiments, the recesses or some of them can also have other shapes.

Even though, in the above description, exemplary embodiments were discussed, it is noted that a large number of modifications are possible. Moreover, it is noted that the exemplary embodiments are solely examples, which are not intended to limit the protective scope, the applications, and the construction in any way. Instead, the above description provides the person skilled in the art a guideline for implementing at least one exemplary embodiment, with it being possible to make diverse changes, in particular in regard to the function and arrangement of the components described, without departing from the protective scope that ensues from the claims and combinations of features equivalent to these.

What is claimed is:

1. A component arrangement for a turbomachine, comprising:

a first flange and a second flange, each with recesses that are distributed in a peripheral direction of distribution; the second flange being detachably fastened to the first flange by a fastener, which engage in a first of these recesses of the first and second flanges, wherein the first flange includes second ones of the recesses, at least one of the second ones of the recesses of the first flange which are free of a fastener, are covered by the second flange, and wherein the second flange includes at least one second one of the recesses that is free of a fastener and is covered by the first flange.

2. The component arrangement according to claim 1, wherein a third flange with recesses distributed in the direction of distribution and is detachably fastened to the first flange by a fastener, which engage in first recesses of the first, second and third flanges; the second ones of the recesses of the first flange, which are free of a fastener, are covered by the third flange and, on both sides, by the second and third flanges.

3. The component arrangement according to claim 2, wherein second ones of the recesses of the third flange, which are free of a fastener, are covered by the first flange and are aligned with the second ones of the recesses, which are free of a fastener, of the second flange that are covered by the first flange.

4. The component arrangement according to claim 2, wherein, between at least one pair of arrangements of the first flange that are adjacent in the direction of distribution, each of which is composed of one of: one or more, and at most four, of first recesses of the first flange, which are adjacent in the direction of distribution, in which a fastener engages, and a pair of arrangements of the second and/or third flange that are adjacent in the direction of distribution, each of which is composed of one of: one or more and at most four first recesses of the respective flange that are adjacent in the direction of distribution, and in which the fastener engages, an odd number differing by one of the second recesses are arranged.

5. The component arrangement according to claim 2, wherein a total number of the first recesses of the second flange and/or of the third flange is equal to a total number of second recesses of the respective flange, and/or to the total number of first recesses of the first flange.

6. The component arrangement according to claim 2, wherein the first and/or second recesses of the first, second, and/or third flange have inner diameters that differ from one another by at most 10%.

7. The component arrangement according to claim 2, wherein the first flange is configured as part of a rotor disk and the second and/or third flange are configured for connection to an adjacent rotor disk.

8. The component arrangement according to claim 1, wherein at least one of the flanges has arrangements, alternating in the direction of distribution, which are composed of one of: one, two, a plurality of and at most four, second recesses of the respective flange, which are adjacent in the direction of distribution, and arrangements, which are composed of one of one, two, a plurality of and at most four, first recesses of the respective flange, which are adjacent in the direction of distribution.

9. The component arrangement according to claim 8, wherein the first recesses, which are adjacent in the direction of distribution, of these arrangements, which are composed of first recesses, of at least one of the flanges are arranged symmetrically and/or are spaced apart equidistant from one another and/or from adjacent second recesses of these arrangements of the respective flange, which are composed of second recesses, and/or second recesses, which are adjacent in the direction of distribution, of these arrangements, which are composed of second recesses, of at least one of the flanges are arranged symmetrically and/or are spaced apart equidistant from one another and/or from adjacent first recesses of these arrangements of the respective flange, which are composed of first recesses.

10. The component arrangement according to claim 1, wherein a total number of first recesses of the first flange is unequal to and is greater than a total number of second recesses of the first flange by at least 10% and at most 100% greater.

11. The component arrangement according to claim 1, wherein the fastener is a plurality of screws with respective screwed on nuts.

12. The component arrangement according to claim 1, wherein at least one component arrangement is configured and arranged in a gas turbine with at least one rotor.

13. The component arrangement according to claim 1, wherein at least one rotor includes flanges that are detachably fastened to one another by the fastener.

* * * * *